US010234797B2

(12) United States Patent
Aiba

(10) Patent No.: US 10,234,797 B2
(45) Date of Patent: Mar. 19, 2019

(54) IMAGE FORMING APPARATUS

(71) Applicant: CANON KABUSHIKI KAISHA, Tokyo (JP)

(72) Inventor: Shozo Aiba, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/642,714

(22) Filed: Jul. 6, 2017

(65) Prior Publication Data

US 2018/0017904 A1 Jan. 18, 2018

(30) Foreign Application Priority Data

Jul. 13, 2016 (JP) ..... 2016-138695
Jul. 13, 2016 (JP) ..... 2016-138696

(51) Int. Cl.
*G03G 15/16* (2006.01)
*G03G 15/00* (2006.01)

(52) U.S. Cl.
CPC ..... *G03G 15/1665* (2013.01); *G03G 15/1675* (2013.01); *G03G 15/55* (2013.01); *G03G 2215/00569* (2013.01)

(58) Field of Classification Search
CPC ..... G03G 15/1675; G03G 15/1605; G03G 15/1665; G03G 2215/0132; G03G 15/161
USPC ..... 399/66
See application file for complete search history.

(56) References Cited

U.S. PATENT DOCUMENTS 9,195,179 B2 11/2015 Shimizu et al.
2004/0062560 A1* 4/2004 Mochizuki ..... G03G 15/1635 399/49
2006/0013602 A1* 1/2006 Lee ..... G03G 15/2046 399/45
2007/0179737 A1* 8/2007 Kalokitis ..... G01C 7/04 702/150
2008/0253814 A1* 10/2008 Suzuki ..... G03G 15/2039 399/320
2009/0196638 A1* 8/2009 Sukesako ..... G03G 15/0131 399/45
2015/0277300 A1* 10/2015 Hironaka ..... G03G 15/1675 399/66
2015/0362870 A1* 12/2015 Ogushi ..... G03G 15/1665 399/66

FOREIGN PATENT DOCUMENTS

JP 2013-174875 A 9/2013

OTHER PUBLICATIONS

Translation of Osawa (JP 06194901 A) listed in the IDS, publication date: Jul. 15, 1994.*
U.S. Appl. No. 15/467,109, filed Mar. 23, 2017, Shozo Aiba.
U.S. Appl. No. 15/642,727, filed Jul. 6, 2017, Shozo Aiba.

* cited by examiner

*Primary Examiner* — Walter L Lindsay, Jr.
*Assistant Examiner* — Frederick Wenderoth
(74) *Attorney, Agent, or Firm* — Venable LLP

(57) ABSTRACT

An image forming apparatus includes an image bearing member, a transfer body, a bias applying portion, a current detection unit, and a control unit. The control unit is configured to change the upper limit voltage based on the current detected by the current detection unit in a state where a test bias is applied to the transfer portion during a non-image forming period, and a voltage of the test bias being applied.

17 Claims, 8 Drawing Sheets

IMAGE FORMING APPARATUS

BACKGROUND OF THE INVENTION

Field of the Invention

The present invention relates to an image forming apparatus configured to form images on a recording material using an electro-photographic system or an electrostatic recording system.

Description of the Related Art

Hitherto, image forming apparatuses adopting an electrophotographic system are widely applied as copying machines, printers, plotters, facsimile machines, and multifunction machines having a plurality of these functions. In these types of image forming apparatuses, a configuration is known where a toner image formed on a photosensitive drum serving as an image bearing member is first primarily transferred to an intermediate transfer belt serving as an intermediate transfer body, and then secondarily transferred to a recording material, i.e., a sheet. An intermediate transfer belt in which a conductive agent is added to a resin material to adjust an electric resistance value to a desirable value is proposed.

In this type of image forming apparatus, classifications of sheets are defined by sheet type, such as sheet thickness, grammage and surface property, in order to correspond to various transfer materials. Further, an image forming apparatus is generally known in which a user designates the classification of the sheet being used for each sheet tray, in which transfer conditions and fixing conditions are changed according to the designated sheet classification. One example of change of transfer conditions is a case where the conditions are changed since a resistance value of the sheet differs greatly from a reference value, and toner cannot be transferred properly. In this case, for example, allotted voltage of a sheet may be adjusted to a setting corresponding to the resistance value of the sheet, or bias settings of a leading end portion and a trailing edge portion may be weakened compared to a center portion in order to prevent image defects caused at the leading end portion or the trailing end portion of the sheet. Further, even if the sheets belong to the same sheet classification, the electric resistance or other physical properties of the sheets may differ, and optimum transfer conditions and fixing conditions may not be obtained.

In order to cope with such condition, an image forming apparatus equipped with an adjustment function in which a user can set transfer conditions and fixing conditions on a user mode screen is known (Japanese Unexamined Patent Application Publication No. 2013-174875). One of such transfer conditions is a secondary transfer voltage. In that case, in the user mode, the user sets the secondary transfer voltage freely within a high voltage guarantee range of high voltage power supply, and a secondary transfer voltage corresponding to the set voltage is output from the high voltage power supply.

According to the image forming apparatus disclosed in the above-mentioned Japanese Unexamined Patent Application Publication No. 2013-174875, the user can set the secondary transfer voltage freely within the high voltage guarantee range of high pressure power supply, and the secondary transfer voltage set by the user is output from the high voltage power supply. There is a possibility that the secondary transfer voltage set by the user is set to an excessive voltage setting with respect to an impedance of the secondary transfer portion, due to reasons such as usage environment and durability. In this case, secondary transfer voltage is applied excessively from the high voltage power supply to the secondary transfer portion, and a current value exceeding the high voltage guarantee range may be supplied to the secondary transfer portion.

In order to cope with this problem, generally, a protection circuit is provided to a high voltage substrate in order to prevent heat generation or ignition, or to prevent failure caused by discharge within the substrate. Therefore, if a current value exceeding the high voltage guarantee range described above is supplied to the secondary transfer portion, the protection circuit is activated. Protection operations performed here may include an operation to switch to intermittent oscillation operation to prevent overcurrent from flowing continuously and cause heating, or an operation to switch off the high voltage output.

However, during such operation of the protection circuit, toner image on the intermediate transfer belt will not be transferred properly to the sheet, and a problem occurs in which image defects such as loss of image information may be caused in the end. In order to prevent such image defects caused by excessive voltage setting from occurring, it may be possible to set a uniform upper limit to the setting range of the secondary transfer voltage that the user can select. However, there are various types of sheets with different resistance values, differing in orders of a few digits or greater, even within the same sheet classification, or resistance values may differ in units of digits by moisture content, even if the sheets are of the same type, depending on the management condition of the sheets. Therefore, if the upper limit of the secondary transfer voltage is set in correspondence with a minimum resistance value, in a state where the resistance value is significantly greater than that value, the upper limit may be set to a value significantly lower than the true upper limit of the secondary transfer voltage that does not cause image defects. Thereby, the setting range of the secondary transfer voltage may be narrowed unnecessarily, and an optimum transfer condition may not be selected. Therefore, there is a demand for a system that enables the transfer voltage to be set by the user, while suppressing occurrence of image defects, without unnecessarily narrowing the setting range of the transfer voltage.

Meanwhile, there may be a case where the setting range is not reflected on the operation screen that the user uses for operation, such that the user is actually changing the set value on the operation screen, but the setting is not actually reflected and the transfer condition is not changed. There is a drawback in that the user checks the sheet in which the setting is not reflected in forming the image to optimize the transfer conditions, such that the workload is increased. Thus, there is a demand for a system that enables the transfer voltage to be set by the user, while suppressing occurrence of image defects, and reducing the workload related to optimizing the image quality.

SUMMARY OF THE INVENTION

According to a first aspect of the present invention, an image forming apparatus includes an image bearing member configured to bear a toner image, a transfer body configured to form a transfer portion with the image bearing member, a bias applying portion configured to apply a transfer bias to the transfer portion, the toner image borne on the image bearing member being transferred to a recording material passing through the transfer portion by the bias applying portion applying the transfer bias to the transfer portion, a current detection unit configured to detect a current supplied to the transfer portion, and a control unit configured to control the bias applying portion such that the transfer bias applied by the bias applying portion is not set to exceed an upper limit voltage. The control unit is configured to change the upper limit voltage based on the current detected by the current detection unit in a state where a test bias is applied to the transfer portion during a non-image forming period, and a voltage of the test bias being applied.

According to a second aspect of the present invention, an image forming apparatus includes an image bearing member configured to bear a toner image, a transfer body configured to form a transfer portion with the image bearing member, a bias applying portion configured to apply a transfer bias to the transfer portion, the toner image borne on the image bearing member being transferred to a recording material passing through the transfer portion by the bias applying portion applying the transfer bias to the transfer portion, a current detection unit configured to detect a current supplied to the transfer portion, an operation portion through which an operator can change a setting of the transfer bias, a display portion configured to display information related to a setting value of the transfer bias after the setting is changed via the operation portion, and a control unit configured to control the transfer bias applied to the transfer body in a state where an image is formed. The control unit is configured to change a range of settings capable of being changed by the operation portion based on the current detected by the current detection unit in a state where a test bias is applied to the transfer portion during a non-image forming period, and a voltage of the test bias being applied.

Further features of the present invention will become apparent from the following description of exemplary embodiments with reference to the attached drawings.

DESCRIPTION OF THE EMBODIMENTS

First Embodiment

Now, a first embodiment of the present invention will be described with reference to FIGS. 1 through 5. According to the present embodiment, a tandem-type full color printer is described as an example of an image forming apparatus 1. However, the present invention is not restricted to a tandem type image forming apparatus 1, and can be other types of image forming apparatuses, or can be monochrome or mono color instead of full color. It can be implemented for various purposes, in printers, various printing machines, copying machines, facsimile machines, and multi-function devices.

Figure 1:
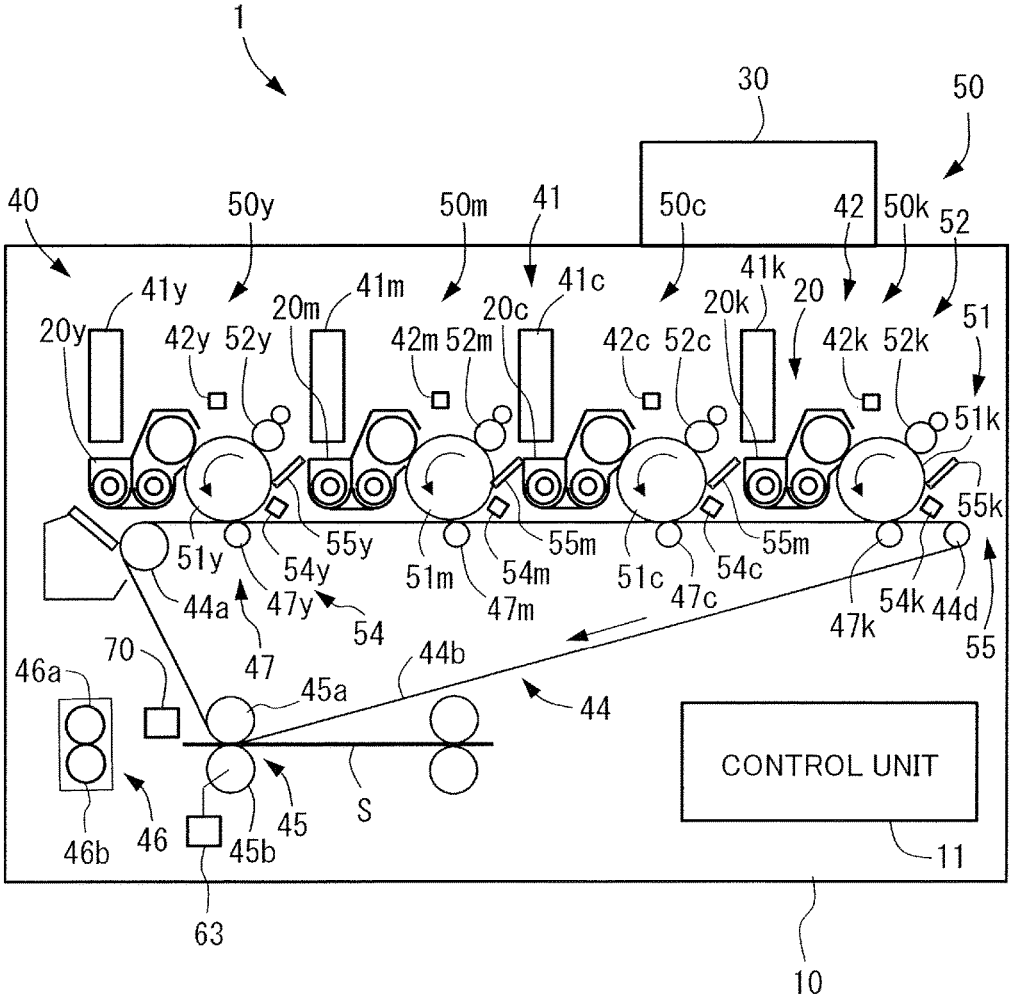
FIG. 1 is a cross-sectional view illustrating a schematic configuration of an image forming apparatus according to a first embodiment.

As illustrated in FIG. 1, the image forming apparatus 1 comprises an apparatus body 10, a sheet feeding unit (not shown) an image forming portion 40, a sheet discharge portion (not shown) a control unit 11, a temperature and humidity sensor 70, and an operation panel 30. The image forming apparatus 1 is configured to form a four-color full color image on a recording material according to an image signal from a host device such as a document reading apparatus (not shown) or a personal computer, or from an external device such as a digital camera or a smartphone. A toner image is formed on a sheet S serving as a recording material, and actual examples of the sheet S include normal paper, synthetic resin sheets as substitute for normal paper, cardboard, and OHP sheets.

The image forming portion 40 is capable of forming an image based on image information on the sheet S fed from a sheet feeding unit. The image forming portion 40 includes image forming units 50*y*, 50*m*, 50*c* and 50*k*, toner bottles 41*y*, 41*m*, 41*c* and 41*k*, exposing units 42*y*, 42*m*, 42*c* and 42*k*, an intermediate transfer unit 44, a secondary transfer portion 45, and a fixing unit 46. The image forming apparatus 1 according to the present embodiment corresponds to full color printing, and the image forming units 50*y*, 50*m*, 50*c* and 50*k* are provided individually with similar configurations for each of the four colors, which are yellow (y), magenta (m), cyan (c) and black (k). In FIG. 1, identifiers indicating color are added to the end of reference numbers in the respective configurations of the four colors, but in FIG. 2 and in the specification, the configurations may be illustrated without adding the identifiers indicating color to the end of the reference numbers.

The image forming unit 50 includes a photosensitive drum, serving as photoconductor, 51 configured to bear a toner image, a charging roller 52, a developing apparatus 20, a pre-exposure unit 54, and a regulating blade 55. The image forming unit 50 is formed as a unit integrally as a process cartridge, and configured to be attached to or detached from the apparatus body 10.

The photosensitive drum 51 is rotatable, and bears an electrostatic image used for forming images. In the present embodiment, the photosensitive drum 51 is an organic photoconductor (OPEC) having negative changeability with an outer diameter of 30 mm, and it is driven to rotate in an arrow direction at a process speed, i.e., peripheral speed, of 210 mm/sec, for example. The photosensitive drum 51 has an aluminum cylinder as base, and on the surface of the cylinder are sequentially coated and laminated an under coating layer, an optical charge generating layer, and a charge transfer layer.

Figure 2:
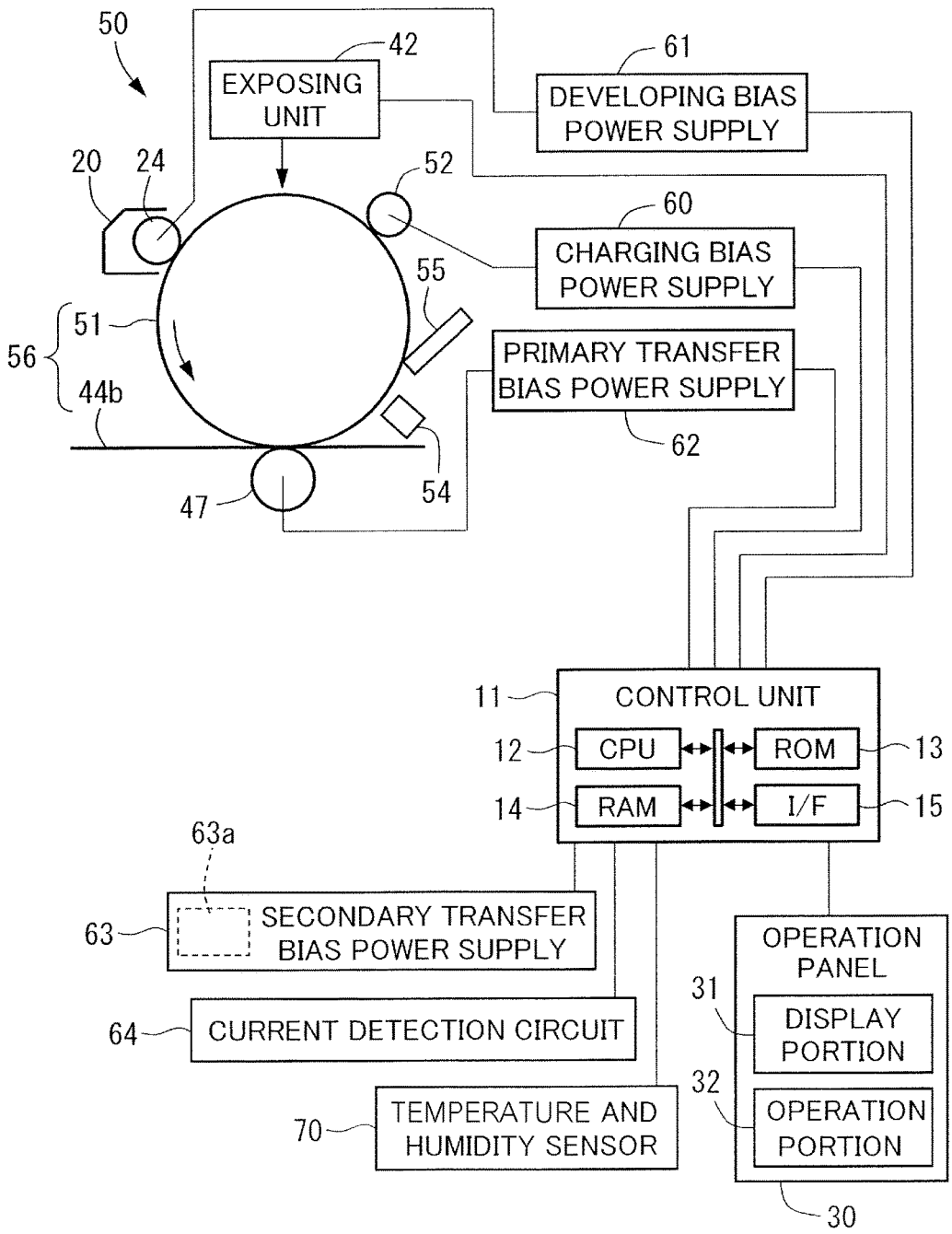
FIG. 2 is a control block diagram showing an outline of the image forming apparatus according to the first embodiment.

The charging roller 52 has a rubber roller that contacts the surface of the photosensitive drum 51 and driven to rotate, and it is configured to charge the surface of the photosensitive drum 51 uniformly. As illustrated in FIG. 2, a charging bias power supply 60 is connected to the charging roller 52. The charging bias power supply 60 applies DC voltage as charging bias to the charging roller 52, and charges the photosensitive drum 51 through the charging roller 52. An exposing unit 42 is a laser scanner, and it emits laser beams according to image information of separated colors output from the control unit 11.

The developing apparatus 20 develops an electrostatic image formed on the photosensitive drum 51 using toner stored therein in a state where a developing bias is applied thereto. The developing apparatus 20 includes a developing sleeve 24. A developing bias power supply 61 configured to apply developing bias is connected to the developing sleeve 24.

The toner image developed on the photosensitive drum 51 is primarily transferred to an intermediate transfer belt 44*b* described later. After primary transfer, the surface of the photosensitive drum 51 is discharged by the pre-exposure unit 54. The regulating blade 55 adopts a counter blade system, and it is an elastic blade mainly formed of urethane with an 8-mm free blade length, pressed against the photosensitive drum 51 with a predetermined pressing force.

As illustrated in FIG. 1, the intermediate transfer unit 44 includes a plurality of rollers including a drive roller 44*a*, a driven roller 44*d*, and primary transfer rollers 47*y*, 47*m*, 47*c* and 47*k*, and an intermediate transfer belt 44*b* wound around these rollers and configured to bear the toner image. The primary transfer rollers 47*y*, 47*m*, 47*c* and 47*k* are respectively arranged to oppose to photosensitive drums 51*y*, 51*m*, 51*c* and 51*k*, and are abutted against the intermediate transfer belt 44*b*.

As illustrated in FIG. 2, the primary transfer roller 47 is arranged to oppose to the photosensitive drum 51 on an inner side of the intermediate transfer belt 44*b*. The primary transfer roller 47 is formed of a metal roller of materials such as SUM (sulfur and sulfur composite free-cutting steel) or SUBS (stainless steel). The primary transfer roller 47 has a straight shape extending in a thrust direction, and a diameter of the roller is approximately 6 to 10 mm. A primary transfer bias power supply 62 (refer to FIG. 2) for applying primary transfer bias is connected to the primary transfer roller 47, and a voltage of an opposite polarity as a charging polarity of toner is applied from the primary transfer bias power supply 62. Thereby, a primary transfer contrast, which is a potential difference between surface potential of the photosensitive drum 51 and a potential of the primary transfer roller 47, is formed. In a state where a predetermined primary transfer contrast is respectively formed to each primary transfer portion, the respective toner images on each photosensitive drum 51 are sequentially electrostatically attracted to the intermediate transfer belt 44*b*, and a superposed toner image is formed on the intermediate transfer belt 44*b*.

The intermediate transfer belt 44*b* as an example of the image bearing member and intermediate transfer body forms a primary transfer portion with the photosensitive drum 51, and in a state where primary transfer bias is applied, the toner image formed on the photosensitive drum 51 is primarily transferred at a primary transfer portion. That is, the intermediate transfer belt 44*b* bears the toner image transferred from the photosensitive drum 51. In a state where a primary transfer bias of positive polarity is applied to the intermediate transfer belt 44*b* from the primary transfer roller 47, toner images having negative polarities formed on the photosensitive drums 51 are sequentially transferred in multiple layers to the intermediate transfer belt 44*b*. A tension of approximately 29 to 118 N (approximately 3 to 12 kg) is applied to the intermediate transfer belt 44*b*. The intermediate transfer belt 44*b* and the photosensitive drum 51 form an image bearing portion 56.

The intermediate transfer belt 44*b* is an endless belt composed of a single layer. Examples of actual materials are as follows: polyimide, polycarbonate, polyvinylidene fluoride (PVDF), polyphenylene sulfide, polyethylene, polypropylene, polystyrene, polyamide, polysulphone, and polyarylate. Further, resin single material such as polyethylene terephthalate, polybutylene terephthalate, polyether sulfone, polyether nitrile, ethylene tetrafluoro ethylene and polyether ether ketone, or a mixture thereof can be used.

In the present embodiment, a polyimide resin or a polyether ether ketone resin is used as the material of the intermediate transfer belt 44*b*. The thickness of the intermediate transfer belt 44*b* is approximately 60 to 70 μm. A surface resistivity of the intermediate transfer belt 44*b* is set to $1.0\times10^{12}$ Ω/□ or greater and $2.0\times10^{12}$ Ω/□ or smaller, and a volume resistivity thereof is set to $4.0\times10^{11}$ Ω·cm or greater and $2.0\times10^{11}$ Ω·cm or smaller. The resistivity was measured using a measuring device called Hiresta UP (product of Mitsubishi Chemical Corporation) and a measuring probe called URS (outer diameter of guard electrode: φ17.9 mm) (product of Mitsubishi Chemical Corporation) under a measurement condition of 100 V applied voltage and 10 seconds charge.

As illustrated in FIG. 1, the secondary transfer portion 45 includes a secondary transfer inner roller 45*a* and a secondary transfer outer roller, serving as transfer body, 45*b*. The secondary transfer inner roller 45*a* is formed by arranging an EPDM (ethylene-propylene-diene rubber) around a core metal. The secondary transfer inner roller 45*a* is formed to have a roller diameter of 20 mm and a rubber thickness of 0.5 mm, and a hardness is set to 70° (Ascar C), for example. Further, the secondary transfer inner roller 45*a* is grounded.

A secondary transfer bias power supply, serving as a bias applying portion, 63 is connected to the secondary transfer outer roller 45*b*, configured to output and apply secondary transfer bias as output voltage to the secondary transfer outer roller 45*b*. The secondary transfer bias power supply 63 includes a protection circuit 63*a* configured to stop application of the secondary transfer bias if a current equal to or greater than a predetermined value is supplied to the secondary transfer portion 45. The secondary transfer outer roller 45*b* abuts against the intermediate transfer belt 44*b* and forms the secondary transfer portion 45 with the intermediate transfer belt 44*b*, and in a state where a secondary transfer bias is applied, the toner image having been primarily transferred to the intermediate transfer belt 44*b* is transferred via secondary transfer to a sheet S passing through the secondary transfer portion 45. The secondary transfer outer roller 45*b* is formed by providing an elastic layer formed of NBR (nitrile rubber) containing ion conductive agent such as a metal complex, or EPDM, around the core metal. The secondary transfer outer roller 45*b* is formed to have a core metal diameter of 12 mm, and a roller diameter including the elastic layer of 24 mm. A resistance value of the secondary transfer outer roller 45*b* is set to $3.0\times10^{7}$ through $5.0\times10^{7}$ Ω, and in the secondary transfer portion 45, the resistance values of the secondary transfer inner roller 45*a* and the intermediate transfer belt 44*b* are set sufficiently smaller than the resistance value of the secondary transfer outer roller 45*b*. A current detection circuit, serving as a current detection unit, 64 (refer to FIG. 2) capable of detecting current supplied to the secondary transfer outer roller 45*b* is connected to the secondary transfer outer roller 45*b*.

The fixing unit 46 includes a fixing roller 46*a* and a pressure roller 46*b*. In a state where a sheet S is nipped and conveyed between the fixing roller 46*a* and the pressure roller 46*b*, the toner image transferred onto the sheet S is heated, pressed and fixed to the sheet S. After fixture, the sheet discharge portion feeds the sheet S conveyed through a sheet discharge path and discharges the sheet through a sheet discharge port onto a sheet discharge tray, for example.

As illustrated in FIG. 2, the control unit 11 is composed of a computer or a controller, which includes, for example, a CPU 12, a ROM 13 configured to store programs for controlling various units, a RAM 14 configured to temporarily store data, and an input output circuit (I/F) 15 configured to input and output signals from/to an exterior. The CPU 12 is a microprocessor configured to control the whole image forming apparatus 1, and it is a subject of a system controller. The CPU 12 is connected to the sheet feeding unit, the image forming portion 40, the sheet discharge portion and the operation panel 30 via the input output circuit 15, configured to communicate signals with the respective units and control operations thereof. An image forming control sequence for forming an image on a sheet S is stored in the ROM 13. The operation panel 30 includes a display portion 31 and an operation portion 32 (refer to FIG. 3). A user can set a number of sheets to be printed, a type of sheet set in each sheet cassette, a size of the sheet and so on by operating the operation portion 32. The display portion 31 can display a value related to a target value of an output voltage. The operation portion 32 can change the setting of the secondary transfer bias by the user (operator) entering the target value of the output voltage.

A charging bias power supply 60, a developing bias power supply 61, a primary transfer bias power supply 62, a secondary transfer bias power supply 63, a current detection circuit 64 and a temperature and humidity sensor 70 are connected to the control unit 1. The temperature and humidity sensor 70 is provided inside the apparatus body 10, and configured to detect temperature and humidity. The control unit 11 is capable of detecting temperature and humidity or absolute moisture content by the temperature and humidity sensor 70. Further, the control unit 11 determines the secondary transfer bias based on a table stored in the ROM 13 from the detection result of the temperature and humidity sensor 70. The table is set by computing in advance a relationship between the temperature and humidity and the secondary transfer bias such that a desired secondary transfer current is supplied.

The control unit 11 controls the secondary transfer bias power supply 63 (step S17 of FIG. 5) such that the secondary transfer bias applied by the secondary transfer bias power supply 63 does not exceed a predetermined upper limit voltage. The term upper limit voltage refers to a voltage equal to or smaller than the voltage being an operation boundary of the protection circuit 63*a*. The control unit 11 changes the upper limit voltage Vlim based on the current detected by the current detection circuit 64 when a test bias is applied to the secondary transfer outer roller 45*b* during a non-image forming period, and voltage of the test bias being applied (step S12 of FIG. 5). If the secondary transfer bias changed by the operation portion 32 exceeds the upper limit voltage Vlim, the control unit 11 sets the secondary transfer bias to the upper limit voltage Vlim (step S17 of FIG. 5). The control unit 11 sets the upper limit voltage Vlim based on the relationship between the voltages of a plurality of different test biases applied during a non-image forming period and the currents detected by the current detection circuit 64 corresponding to the respective voltages, and the relationship between the voltages and the currents within a high voltage guarantee range being the operation boundary of the protection circuit 63*a* of the secondary transfer bias power supply 63. The secondary transfer bias may be negative, so the upper limit voltage Vlim of an absolute value of the secondary transfer bias is set.

In the present embodiment, an image forming period refers to a state where a toner image is formed on the photosensitive drum 51 based on image information entered from a scanner provided on the image forming apparatus 1 or from an external terminal such as a personal computer. Meanwhile, a non-image forming period refers to a state other than the image forming period, such as when an image forming job is not executed, or during pre-rotation during the image forming job, or a period between sheets. An image forming job refers to a sequence of operations performed based on a print command signal, i.e., image forming command signal, as described below. That is, it refers to a sequence of operations from when a preliminary operation that is required for forming an image, so-called a pre-rotation operation, is started, and through the image forming process, to when a preliminary operation required to end the image forming process, so-called a post-rotation operation, is completed. Specifically, it refers to a state from when pre-rotation, i.e., preparation operation prior to image forming, is performed after a print command signal has been received, i.e., an image forming job has been entered, until post-rotation, i.e., operation performed after image has been formed, and includes an image forming period and the period between sheets, as a non-image forming period. The period between sheets corresponds to a period from an end of formation of a toner image on one sheet to a start of formation of a toner image on the next sheet in a state where successive image forming is performed.

Next, an image forming operation in the image forming apparatus 1 configured as above will be described with reference to FIG. 1.

If the image forming operation is started, at first, the photosensitive drum 51 rotates and the surface is charged by the charging roller 52. Then, the exposing unit 42 emits laser beams to the photosensitive drum 51 based on image information, and an electrostatic latent image is formed on a surface of the photosensitive drum 51. In a state where toner is adhered to the electrostatic latent image, the image is developed as toner image, and the toner image is transferred to the intermediate transfer belt 44*b*.

Meanwhile, a sheet S is supplied simultaneously as the toner image forming operation, and at a matched timing with the toner image on the intermediate transfer belt 44*b*, the sheet S is conveyed to the secondary transfer portion 45 via the conveyance path. Further, an image is transferred from the intermediate transfer belt 44*b* to the sheet S, and the sheet S is conveyed to the fixing unit 46, where unfixed toner image is heated and pressed to be fixed to the surface to the sheet S, before the sheet S is discharged from the apparatus body 10.

Now, a predetermined high voltage guarantee range by the protection circuit 63*a* of the secondary transfer bias power supply 63 will be described. The secondary transfer bias output from the secondary transfer bias power supply 63 is variable. The secondary transfer bias power supply 63 outputs high voltage by constant voltage control having a high voltage guarantee range, and if a current exceeding the high voltage guarantee range is set, the secondary transfer bias power supply 63 is designed to perform intermittent output to prevent heating or damage caused by discharge within the high voltage circuit. The voltage-current information showing the high voltage guarantee range is stored in advance in the ROM 13 of the control unit 11.

Figure 4A:
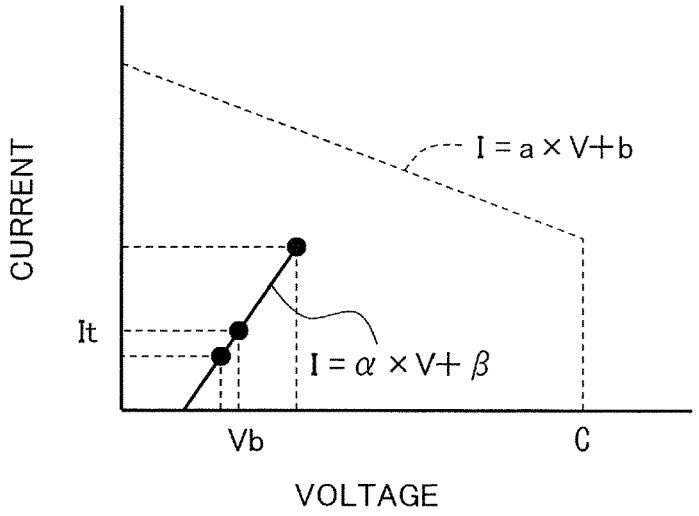
FIG. 4A is a graph illustrating a relationship between applied voltage and current flow to a secondary transfer portion in the image forming apparatus according to the first embodiment.
Figure 4B:
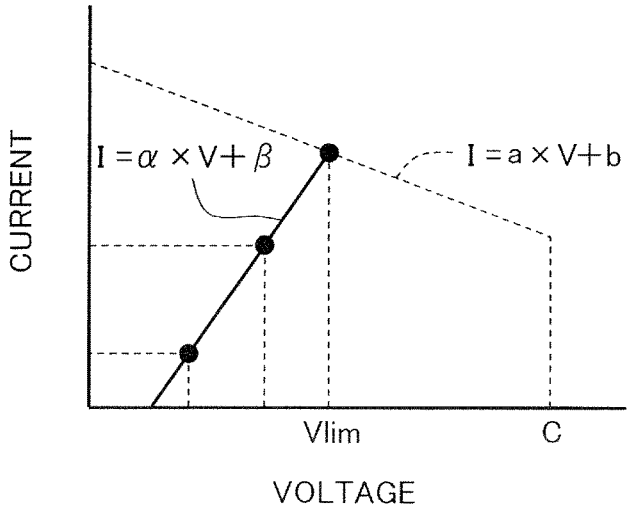
FIG. 4B is a graph of a state where Vlim is acquired illustrating the relationship between applied voltage and current flow to the secondary transfer portion in the image forming apparatus according to the first embodiment.

As illustrated in FIG. 4A, an expression illustrating a boundary of a high voltage guarantee range (illustrated by the broken line in the drawing) can be represented by the following two expressions.

$$I=a\times V+b \text{ (when } 0\leq V<C) \quad \text{(Expression 1)}$$

$$V=C \text{ (when } V\geq C) \quad \text{(Expression 2)}$$

In the present embodiment, a high voltage substrate having the high voltage guarantee range illustrated by the two expressions described above is described, but the high voltage guarantee range differs according to the design of the high voltage circuit, and it is not restricted to that defined by the above expressions.

A voltage V2*tr* applied on the secondary transfer portion 45 during an image forming period is calculated by the following Expression 3. The control unit 11 adds a voltage Vb determined non sheet-feeding period to a voltage Vp given by a sheet allotted voltage table, and applies the voltage V2*tr* to the secondary transfer outer roller 45*b* when the sheet passes the secondary transfer portion 45, to transfer the toner image on the intermediate transfer belt 44*b* to the sheet.

$$V2tr=Vb+Vp \quad \text{(Expression 3)}$$

As described earlier, the secondary transfer outer roller 45*b* is formed of a sponge rubber material in which ion conductive agents are dispersed, such that the roller may be deteriorated depending on a duration state, and a resistance value may be varied. Further, the electric resistance may also be varied by temperature and humidity, such that the voltage must be set to correspond to the resistance of the roller during image forming. According to the present embodiment, in a non-paper-feed period during print operation, two or more different test biases are applied to the secondary transfer outer roller 45*b*, and the current supplied to the secondary transfer portion 45 is detected by the current detection circuit 64. As illustrated in FIG. 4A, an inclination $\alpha$ and an intercept $\beta$ are computed based on the two points of implied voltages of the test bias and the current values respectively detected, and a relationship of $I=V\times\alpha+\beta$ (straight line V-I) is obtained. Then, an automatic transfer voltage control (hereinafter referred to as ATVC) for determining a voltage value for obtaining a desired transfer current is executed. That is, voltages corresponding to the respective roller resistances can be set by the control unit 11 executing ATVC during the image forming operation, and as illustrated in FIG. 4A, a voltage Vb for achieving a desired current (target current It) is determined. Further, the control unit 11 determines a sheet allotted voltage Vp based on the environment information detected by the temperature and humidity sensor by using a sheet allotment table. The voltage V2*tr* applied to the secondary transfer portion 45 during an image forming period can be computed by using the Vb and Vp set as above.

Figure 3:
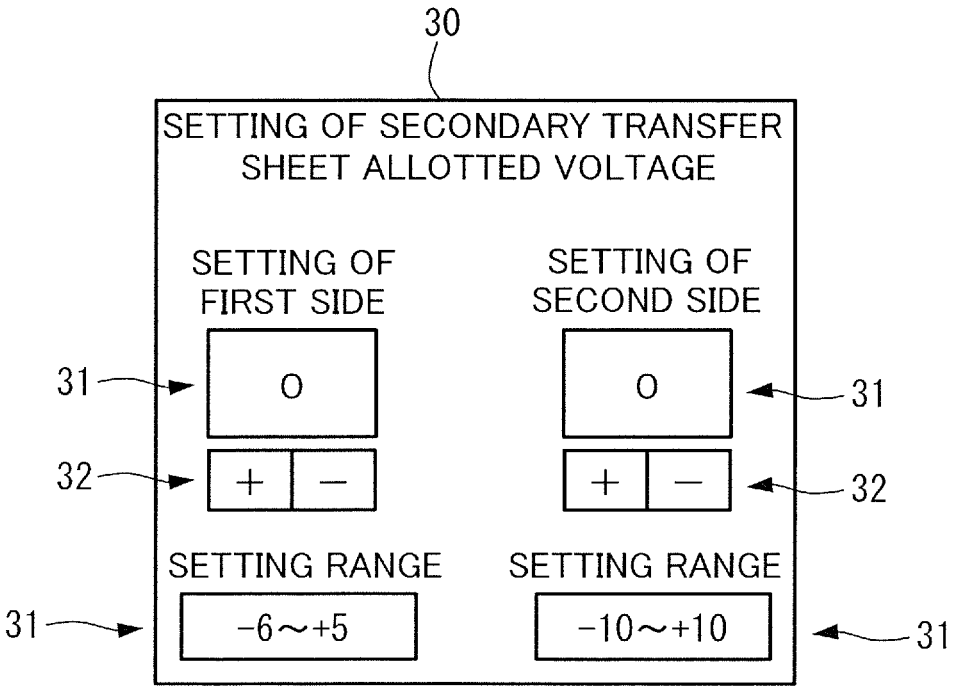
FIG. 3 is a schematic diagram illustrating an operation panel of the image forming apparatus according to the first embodiment.

A case in which the Vb or Vp described above is changed will be described below. As illustrated in FIG. 3, an item for adjusting secondary transfer settings of a first side and a second side for each sheet type is displayed on the display portion 31 of the operation panel 30, and by entering an adjustment value by the operation portion 32 with respect to a reference value (when "0" is displayed), the sheet allotted voltage Vp can be increased or decreased. A setting range is displayed on the display portion 31, and the user can change the setting of the sheet allotted voltage within the range illustrated in the setting range. In the present embodiment, an offset quantity per setting value "1" of the display portion 31 is 100 V, for example, and a setting range "−10 to +10" corresponds to −1000 V to +1000 V of the reference sheet allotted voltage Vp.

For example, if the user prints an image on a sheet having a high (or low) volume resistivity, the user can change the secondary transfer setting such that an offset voltage Vpos corresponding to a difference of sheet resistance is increased (or decreased) based on a value stored in the sheet allotted voltage table provided in advance. Specifically, if it is determined that a good image can be achieved if the first side setting is set to "+5" on the display portion 31 based on the value of the sheet allocated voltage table, the control unit 11 performs a secondary transfer setting in which the offset voltage is increased to Vpos=5×100 V to correspond to the difference in sheet resistance. Then, the control unit 11 reflects Vp' during determination of secondary transfer voltage instead of Vp as Vp'=Vp+Vpos based on the offset voltage Vpos determined by the sheet allocated voltage setting entered by the user.

Now, the upper limit voltage Vlim at secondary transfer will be described. A voltage given by an intersection point of the straight line V-I obtained by the control unit 11 when executing ATVC and the Expression 1 (I=a×V+b) representing the high voltage guarantee area is computed by the following Expression 4, and the voltage is set as the upper limit voltage Vlim. Vlim should preferably be set somewhat lower than Vlim (for example Vlim'=Vlim×95%) considering fluctuation of high voltage output accuracy, current detection accuracy, voltage detection accuracy, deflection of roller resistance, and so on.

$$\text{Vlim}=(\beta-b)/(a-\alpha) \quad \text{(Expression 4)}$$

That is, if a voltage value exceeding Vlim is set by the secondary transfer setting determined by the ATVC of the secondary transfer portion 45 and the operation portion 32, the V2*tr* is set as Vlim, and a current value exceeding the high voltage guarantee range is prevented from being output. For example, in a high temperature and high humidity environment, the resistance value of the secondary transfer outer roller 45*b* drops, and if the user erroneously sets the offset voltage of the sheet allotted voltage Vp that can be entered by the operation portion 32 to a high value, it may be possible that an overcurrent exceeding the high voltage guarantee range is set. In that case, if an overcurrent protection circuit is activated, and the secondary transfer bias power supply 63 performs intermittent output, the toner image on the intermediate transfer belt 44*b* cannot be transferred in an optimized manner to the sheet, and a striped image having reflected the intermittent output during high voltage is formed, such that the image information is deteriorated. According to the image forming apparatus 1 of the present embodiment, even if a voltage value exceeding the high voltage guarantee range is set unintentionally, the secondary transfer bias is determined so that the voltage setting does not activate protection circuit operation, and occurrence of deterioration of image information can be prevented.

Next, we will describe an ATVC in the period between sheets according to the image forming apparatus 1 of the present embodiment. An impedance of the secondary transfer portion 45 including the roller resistance of the secondary transfer outer roller 45*b* varies according to the use mode or the environment of the image forming apparatus 1. If a usage environment itself of the user is varied, there are various causes of change of impedance of the secondary transfer portion 45. For example, there may be a case where a large number of sheets are printed continuously, and heat radiated from the fixing unit 46 increases the temperature inside the apparatus body 10. Further, in a duplex printing mode, a second side is passed through the secondary transfer portion 45 immediately after the sheet has been heated when fixing the image on the first side, and the secondary transfer outer roller 45*b* may be heated by the sheet.

If control for resetting impedance of secondary transfer, i.e. the ATVC in the period between sheets, is performed by applying two or more test biases in a control in the period between sheets during the continuous printing mode in accordance with such change in impedance, the control unit 11 recalculates the upper limit voltage Vlim. The control unit 11 detects the change of impedance of the secondary transfer portion 45 in the ATVC in the period between sheets, and if it is determined that correction of the secondary transfer setting is required, the control unit 11 changes the secondary transfer setting and also changes the upper limit voltage Vlim.

In the present embodiment, the control unit 11 applies two or more test biases during a non-sheet-feed timing during continuous sheet feed as the ATVC in the period between sheets, and detects the currents at those timings. Then, based on the relationship between detected current and applied voltage, the control unit 11 computes a current Iin during application of Vb, determines a deviation from the desired current It, and corrects the secondary transfer bias. Then, if an amount of deviation between the detected current and target current It is equal to or greater than a predetermined amount ΔIth, the control unit 11 offsets the applied voltage such that the current value approximates a desirable range. Specifically, the following determination expressions are used.

If $Iin>It$ and $Iin-It>\Delta Ith$, then $Vb'=Vb-\Delta V$;

If $Iin>It$ and $Iin-It\leq\Delta Ith$, then $Vb'=Vb$;

If $Iin<It$ and $It-Iin\leq\Delta Ith$, then $Vb'=Vb+\Delta V$;

and

If $Iin<It$ and $It-Iin\leq\Delta Ith$, then $Vb'=Vb$

In the ATVC in the period between sheets, the control unit 11 computes the straight line V-I from the two test bias voltages and the currents detected during application of the two biases by the current detection circuit 64, and a Vlim is newly computed by the intersection point with Expression 1 representing the high voltage guarantee area, and updates the value.

Figure 5:
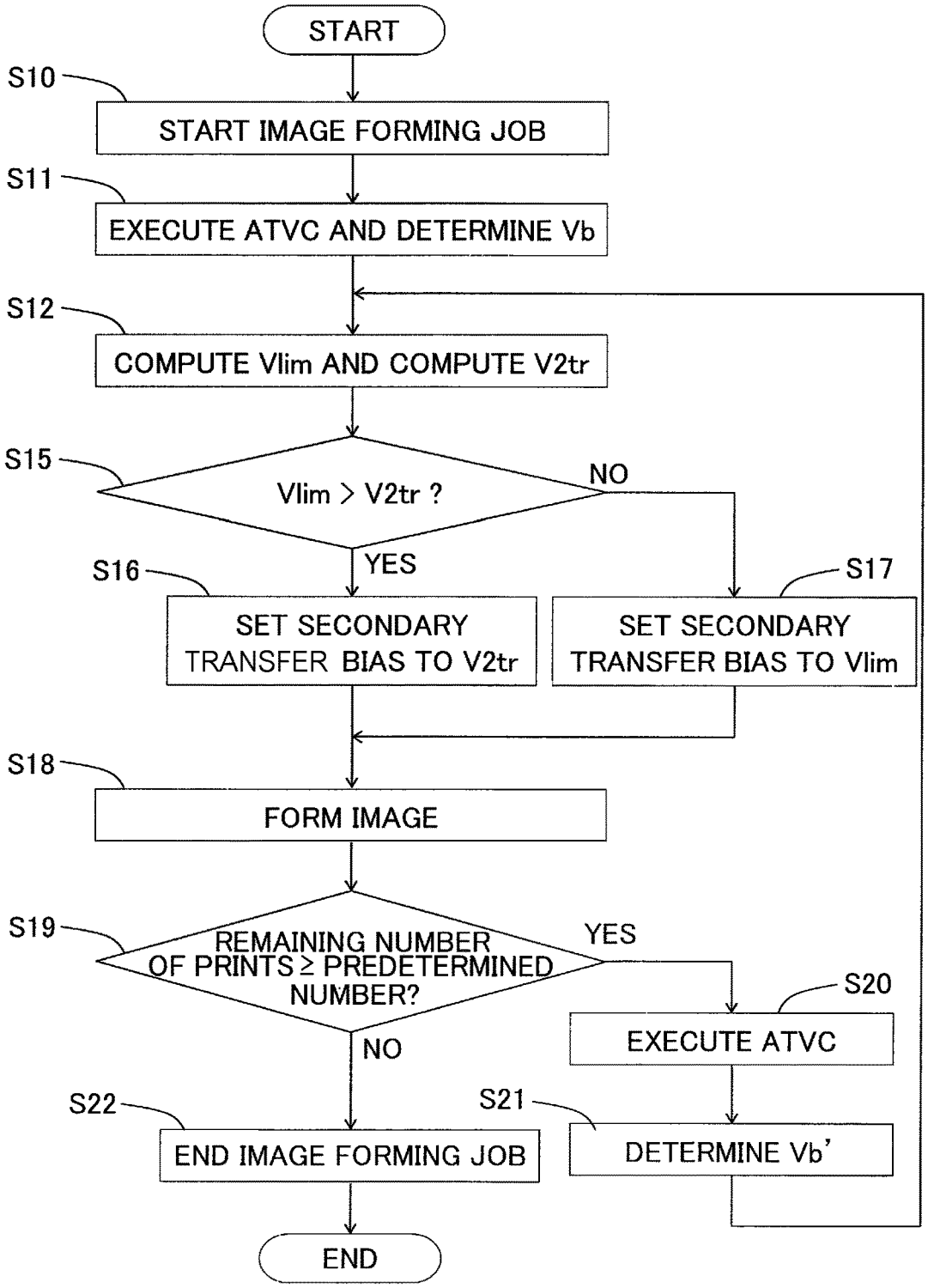
FIG. 5 is a flowchart illustrating a procedure for setting a secondary transfer bias during image forming in the image forming apparatus according to the first embodiment.

Next, a process for setting the secondary transfer bias during an image forming period in the image forming apparatus 1 according to the present embodiment will be described with reference to FIG. 5. It is assumed that the user has entered the secondary transfer settings of the first and second sides in advance using the operation portion 32.

When the image forming job is started (step S10), the control unit 11 executes ATVC during pre-rotation, and determines Vb (step S11). Then, the control unit 11 computes the upper limit voltage Vlim based on Expression 4, and computes the voltage V2*tr* applied to the secondary transfer portion 45 during the image forming period based on Expression 3 (step S12). Further, the control unit 11 determines whether the upper limit voltage Vlim has exceeded the voltage V2*tr* (step S15). If it is determined that the upper limit voltage Vlim has exceeded the voltage V2*tr*, the control unit 11 sets the secondary transfer bias to voltage V2*tr* (step S16). Meanwhile, if it is determined that the upper limit voltage Vlim has not exceeded the voltage V2*tr*, the control unit 11 sets the secondary transfer bias to the upper limit voltage Vlim (step S17). Then, the control unit 11 executes image forming based on the set secondary transfer bias (step S18).

In the present image forming job, the control unit 11 determines whether the remaining number of prints is equal to or greater than a predetermined number of sheets set in advance (step S19). If it is determined that the remaining number of prints is equal to or greater than the predetermined number of sheets set in advance, the control unit 11 executes the ATVC in the period between sheets at a predetermined timing (step S20), updates Vb, and calculates Vb' newly (step S21). Thereafter, the control unit 11 computes the upper limit voltage Vlim for the next image forming process (step S12). In step S19, if the control unit 11 determines that the remaining number of prints is smaller than the predetermined number of sheets set in advance, the image forming job is ended (step S22).

As described, according to the image forming apparatus 1 of the present embodiment, the control unit 11 changes the upper limit voltage Vlim based on the currents detected by the current detection circuit 64 in a state where test biases are applied to the secondary transfer outer roller 45*b* during a non-image forming period, and the voltages of the applied test biases. Therefore, based on the voltages of the test biases and the detected currents, the upper limit voltage Vlim that the secondary transfer bias power supply 63 is capable of applying can be changed to an appropriate level. Thereby, the transfer voltage can be set by the user, while the occurrence of image defects can be suppressed, and the setting range of the transfer voltage can be prevented from being narrowed unnecessarily.

Figure 6:
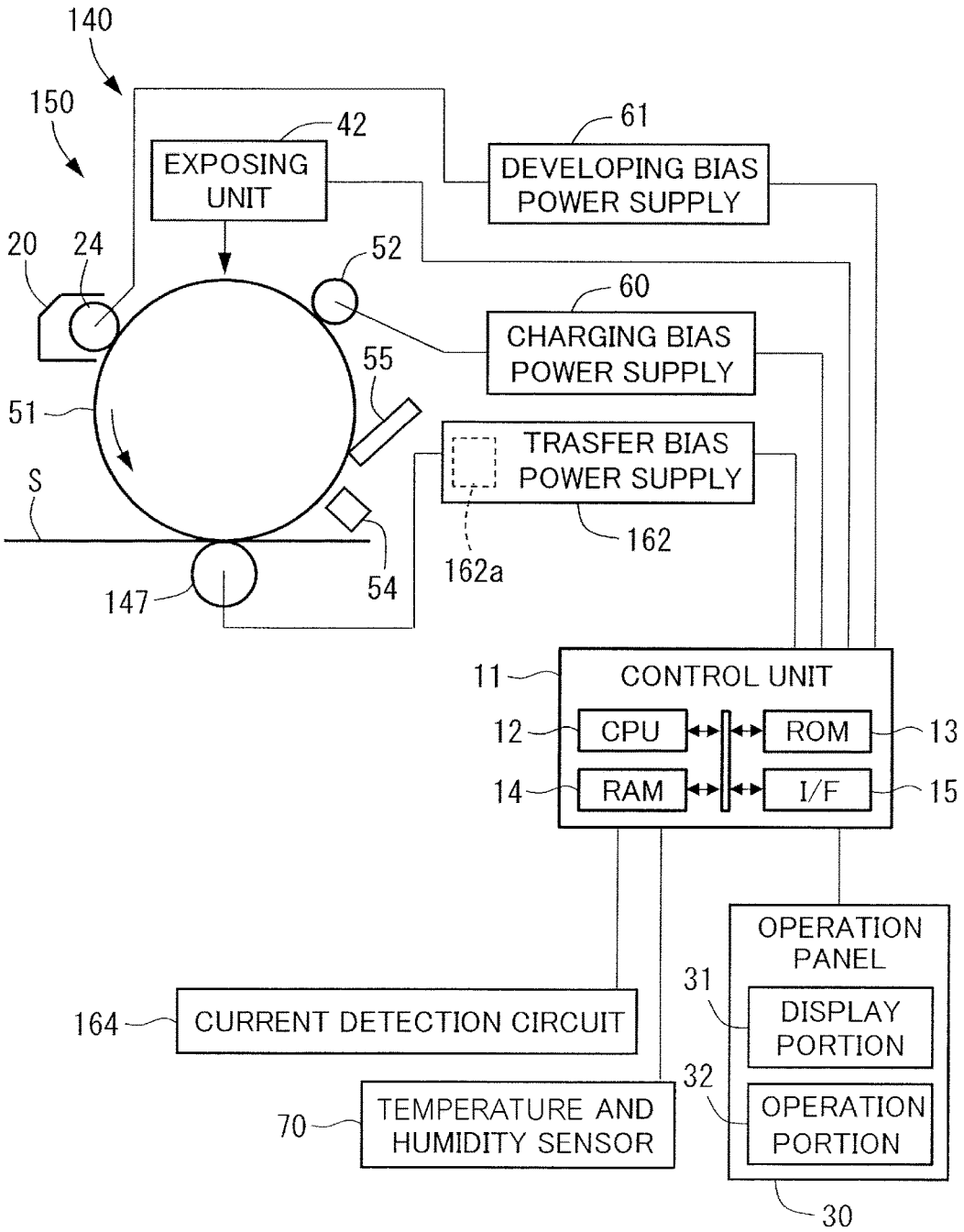
FIG. 6 is a cross-sectional view illustrating a schematic configuration of a photosensitive drum and a surrounding mechanism of a modified example of an image forming apparatus according to the first embodiment.

According to the present embodiment, the image forming apparatus 1 has the intermediate transfer belt 44*b*, and it adopts a system where toner images of respective colors are primarily transferred from the photosensitive drums 51 to the intermediate transfer belt 44*b*, and then the superposed toner images of respective colors are collectively transferred via secondary transfer to the sheet S. However, the apparatus is not restricted to this configuration, and it can adopt a system in which an image is directly transferred to a sheet conveyed on a sheet conveyor belt. In that case, for example as illustrated in FIG. 6, an image forming portion 140 does not include an intermediate transfer unit 44. The image forming portion 140 includes an image forming unit 150, an exposing unit 42, and a toner bottle and a fixing unit (not shown). The image forming unit 150 includes a photosensitive drum, serving as a photoconductor, 51 configured to form a toner image, a charging roller 52, a developing apparatus 20, a pre-exposure unit 54, a regulating blade 55, and a transfer roller, serving as a transfer body, 147.

The transfer roller 147 forms a transfer portion with the photosensitive drum 51, and in a state where a transfer bias is applied to the transfer portion, the toner image formed on the photosensitive drum 51 is transferred to the sheet S. A transfer bias power supply, serving as a bias applying portion, 162 is connected to the transfer roller 147, configured to output and apply the transfer bias as output voltage to the transfer roller 147. A current detection unit, serving as a current detection unit, 164 is connected to the transfer roller 147, configured to detect the current supplied to the transfer roller 147.

Then, the control unit 11 changes the upper limit voltage Vlim based on the currents detected by the current detection circuit 164 in a state where test biases are applied to the transfer roller 147 during a non-image forming period, and the applied test bias voltages. Also according to this case, the transfer bias power supply 162 can change the applicable upper limit voltage Vlim to an appropriate level, such that it becomes possible to suppress occurrence of image defects while enabling the transfer voltage to be set by the user, and prevent the setting range of the transfer voltage from being narrowed unnecessarily.

Second Embodiment

Figure 7:
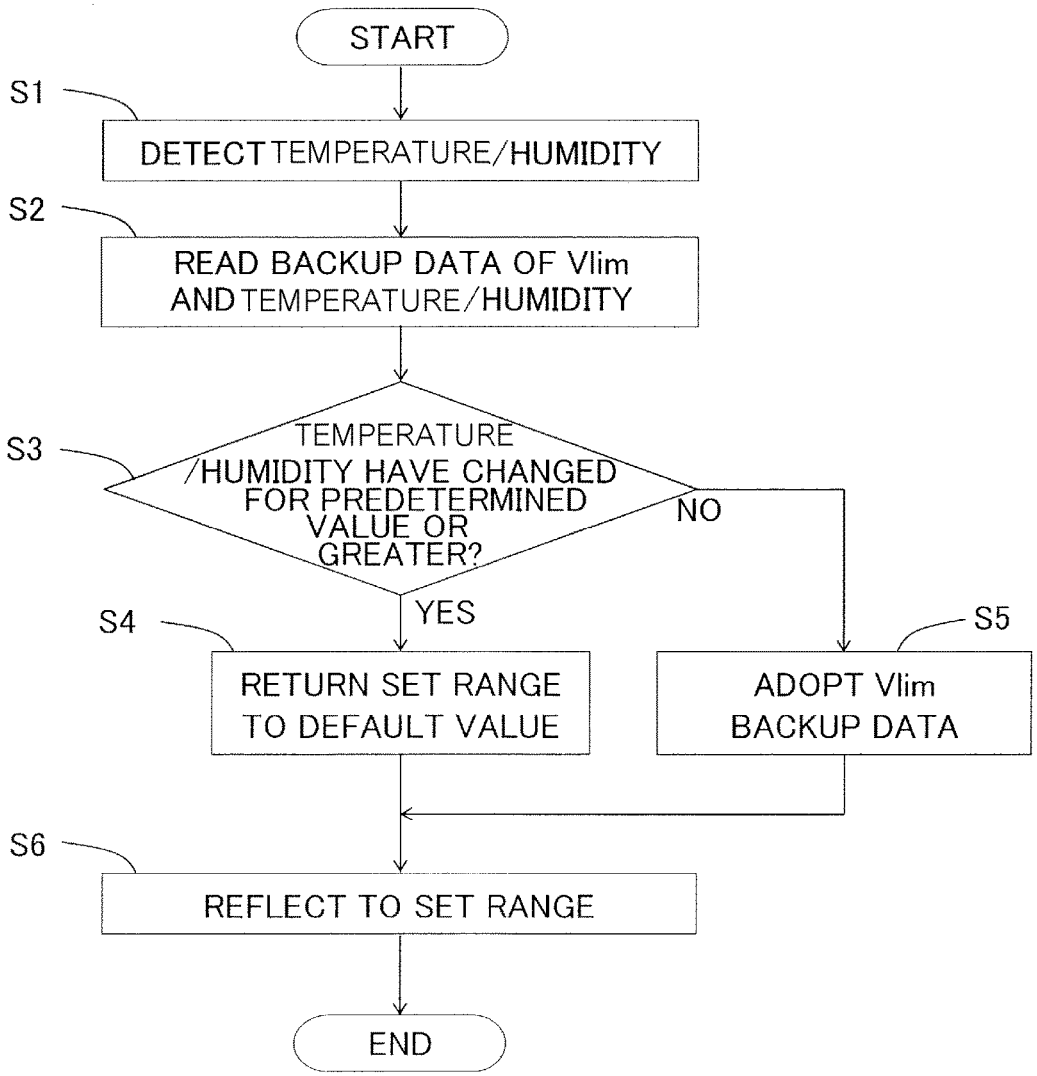
FIG. 7 is a flowchart illustrating a procedure for changing a setting of a sheet allotted voltage according to temperature and humidity in an image forming apparatus according to a second embodiment.
Figure 8:
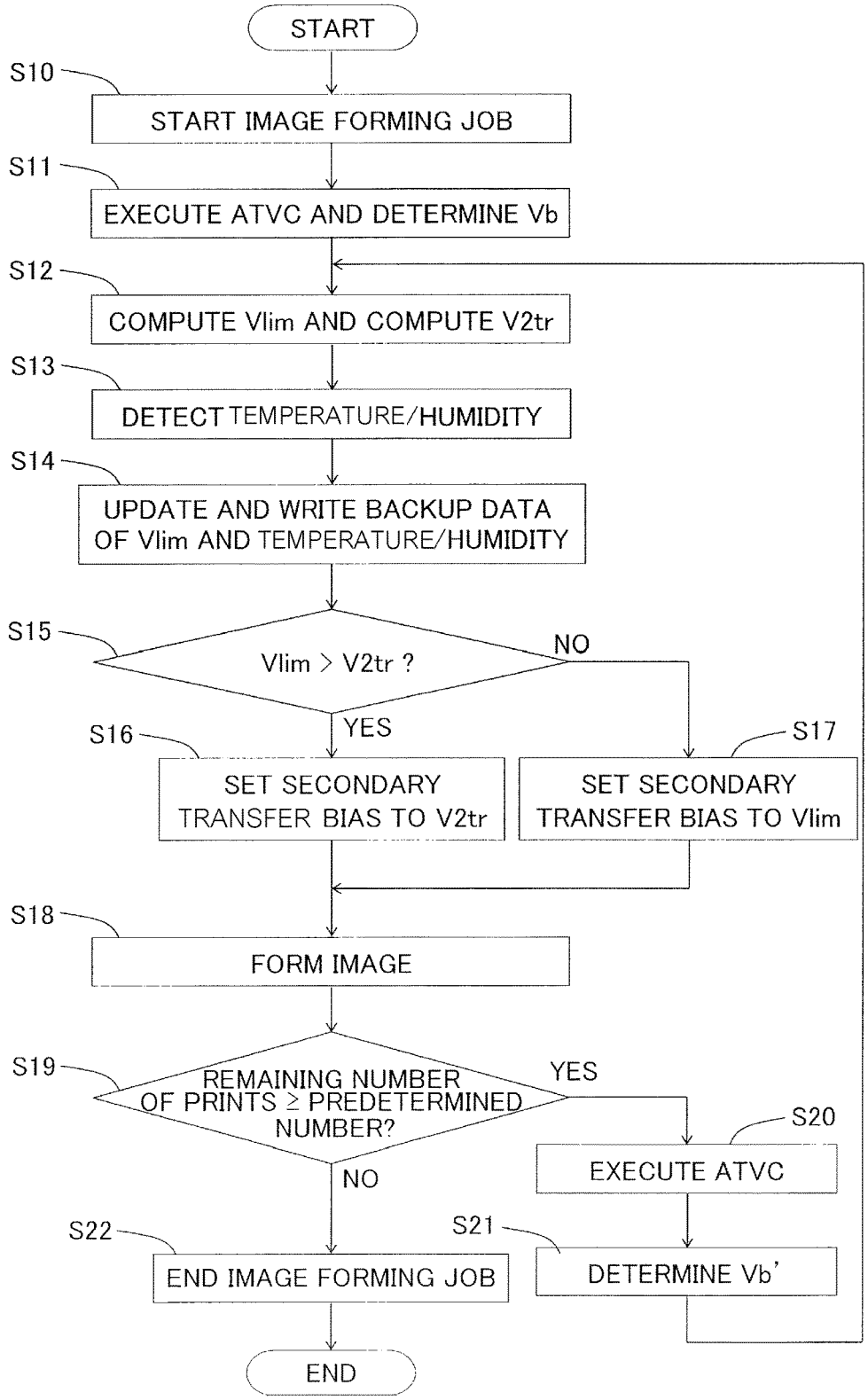
FIG. 8 is a flowchart illustrating a procedure for setting a secondary transfer bias during image forming in the image forming apparatus according to the second embodiment.

Next, a second embodiment of the present invention will be described in detail with reference to FIGS. 7 and 8. A configuration of the present embodiment differs from the configuration of the first embodiment that changes the upper limit voltage Vlim in a point that the control unit 11 changes a setting range that can be changed by the operation portion 32 based on a current detected by the current detection circuit 64 when a test bias is applied to the secondary transfer outer roller 45*b* during a non-image forming period, and a voltage of the applied test bias. However, the other configurations are similar to the first embodiment, so the components are denoted with the same reference numbers, and the detailed descriptions are omitted.

In the present embodiment, the control unit 11 controls the secondary transfer bias applied to the secondary transfer outer roller 45*b* during an image forming period. The control unit 11 changes the range of setting that can be changed by the operation portion 32 based on the current detected by the current detection circuit 64 in a state where a test bias is applied to the secondary transfer outer roller 45*b* during a non-image forming period, and the applied test bias voltage (step S6 of FIG. 7). Further, the control unit 11 sets the upper limit voltage Vlim of the absolute value of the output voltage applicable as secondary transfer bias based on the applied test bias voltage, the current detected by the current detection circuit 64, and the high voltage guarantee range of the secondary transfer bias power supply 63 (step S12 of FIG. 8). The output voltage may be negative, so in this step, the upper limit voltage Vlim of the absolute value of the output voltage is set. The control unit 11 sets the absolute value of the target value of the output voltage to be equal to or smaller than the upper limit voltage Vlim (steps S16 and S17 of FIG. 8). The control unit 11 sets the upper limit voltage Vlim based on the relationship between a plurality of test bias voltages applied during a non-image forming period and the currents detected by the current detection circuit 64 corresponding to the respective voltages, and the relationship between the voltages and currents of the high voltage guarantee range (step S12 of FIG. 8). The control unit 11 sets the range of setting that can be changed by the operation portion 32 to be equal to or smaller than the voltage serving as the operation boundary of the protection circuit 63*a*.

According to the present embodiment, V2*tr* is prevented from exceeding Vlim by the operation of the operation portion 32, such that a voltage value exceeding the high voltage guarantee range is prevented from being set unintentionally. The control unit 11 determines the secondary transfer bias such that the voltage setting does not activate the protection circuit, and events such as failure of image information caused by the activation of the overcurrent protection circuit can be avoided. Specifically, after executing ATVC, the control unit 11 reflects the computed Vlim to the setting range on the display portion 31, and only allows input that falls within the range displayed as the setting range to be entered by the operation portion 32.

An example will be illustrated of a case where, as a result of the ATVC performed by the control unit 11, Vb is computed as 2000 V, the upper limit voltage Vlim is computed as 3500 V, and the sheet allotted voltage Vp is computed as 1000 V. In this case, the voltage V2*tr* of the secondary transfer bias is set to Vb+Vp=3000 V in a state where the sheet allotted voltage setting is "0" on the display portion 31, such that the voltage increase range on the display portion 31 is "+5", and the setting range on the display portion 31 is switched to display "−10 to +5". Meanwhile, the control unit 11 performs display to show the range in which a condition of the sheet allotted voltage Vp≥0 is satisfied on the lower limit side of the sheet allotted voltage range capable of being set on the display portion 31. A sheet allotted voltage table corresponding to an environment where the sheet is a thin paper and the like having a thin thickness, or in a high temperature and high humidity environment where moisture content of the sheet is assumed to be high, is set low compared to the table corresponding to other environments. For example, if Vp=600V, the control unit 11 sets the setting range of the sheet allotted voltage Vp on the display portion 31 to "−6".

Next, a procedure in which the user sets a printing condition in the image forming apparatus 1 according to the present embodiment will be described with reference to FIG. 7. The user adjusts and enters the secondary transfer settings of the first side and the second side using the operation portion 32.

The control unit 11 detects temperature and humidity via a temperature and humidity sensor, serving as an environment information detection unit, 70 (step S1), and reads backup data such as the upper limit voltage Vlim, temperature and humidity stored in the previous image forming job (step S2). Regarding temperature and humidity, the control unit 11 compares the detected value with the backup data, and determines whether there is a change equal to or greater than a predetermined value (such as temperature change of Δ 2 degrees and humidity change of 10%) (step S3).

If it is determined that the detected value has been changed equal to or greater than the predetermined value from the backup data, the control unit 11 will not reflect the backup data of the upper limit voltage Vlim, but adopts a default setting value as the sheet allotted voltage range (step S4). If it is determined that the detected value has not been changed equal to or greater than the predetermined value from the backup data, the control unit 11 adopts the value related to the backup data of the upper limit voltage Vlim linked to the backup data of temperature and humidity as the sheet allotted voltage range (step S5). Then, the control unit 11 displays the value adopted as the sheet allotted voltage range on the display portion 31 (step S6).

Next, a procedure for setting the secondary transfer bias during an image forming period in the image forming apparatus 1 according to the present embodiment will be described with reference to FIG. 8. It is assumed that the user has adjusted and entered the secondary transfer settings of the first and second sides in advance using the operation portion 32 by the procedure illustrated in FIG. 7.

In a state where the image forming job is started (step S10), the control unit 11 executes ATVC during pre-rotation, and determines Vb (step S11). Then, the control unit 11 computes the upper limit voltage Vlim based on Expression 4, and computes the voltage V2*tr* applied to the secondary transfer portion 45 during an image forming period based on Expression 3 (step S12). The control unit 11 detects temperature and humidity by the temperature and humidity sensor 70 (step S13), updates the upper limit voltage Vlim at the current point of time and the backup data of temperature and humidity, and writes the data in the ROM 13 (step S14). The data of the upper limit voltage Vlim and temperature and humidity written in this step is referred to by the control unit 11 before starting the next image forming job (refer to step S2 of FIG. 7). Steps S15 through S22 are similar to steps S15 through S22 of FIG. 5 of the first embodiment, so detailed descriptions thereof are omitted.

As described according to the image forming apparatus 1 of the present embodiment, the control unit 11 detects the current by the current detection circuit 64 in a state where test bias is applied to the secondary transfer outer roller 45*b* during a non-image forming period. Then, the control unit 11 changes the range of settings that can be changed by the operation portion 32 based on the detected current and the voltage of the test bias being applied. Therefore, the range of settings that can be changed by the operation portion 32 regarding the secondary transfer bias applied during secondary transfer to the sheet is changed based on the voltage of the test bias and the detected current. In this manner, occurrence of image defects can be suppressed while enabling the transfer voltage to be set by the user.

Further according to the image forming apparatus 1 of the present embodiment, the display portion 31 displays information regarding the set value of the secondary transfer bias after the value has been changed by the operation portion 32. Since the user can execute the setting operation while confirming the information regarding the setting value of the bias on the display portion 31, the adjustment of transfer conditions can be facilitated, and the work load for optimizing the image quality can be reduced.

According to the image forming apparatus 1 of the present embodiment, the image forming apparatus 1 includes an intermediate transfer belt 44*b*, and a system is adopted where toner images of respective colors are primarily transferred from the photosensitive drums 51 to the intermediate transfer belt 44*b*, and thereafter, a superposed toner image of respective colors is collectively transferred via secondary transfer to the sheet S. However, the present embodiment is not restricted to this system, and it can adopt a system in which the image is directly transferred from the photosensitive drum to the sheet conveyed on the sheet conveyor belt. In that case, the image forming apparatus forms a transfer portion with the photosensitive drum, serving as an image bearing member, 51, and is equipped with a transfer roller, serving as a transfer body, 147 configured to transfer the toner image formed on the photosensitive drum 51 to the sheet in a state where a transfer bias is applied to the transfer portion (refer to FIG. 6). Then, based on the current detected by the current detection circuit 164 when transfer bias is applied to the transfer roller 147 during a non-image forming period, and the voltage of the test bias being applied, the control unit 11 changes the range of setting that can be changed by the operation portion 32. Also in this case, the range of setting that can be changed by the operation portion 32 with respect to the transfer bias for transferring the image on a sheet is changed based on the test bias voltages and the detected currents, and the occurrence of image defects can be suppressed while enabling the transfer voltage to be set by the user. Moreover, since the user can execute the setting operation while confirming the information regarding the setting value of the bias on the display portion 31, the adjustment of transfer conditions can be facilitated, and the work load for optimizing the image quality can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-138695, filed Jul. 13, 2016, and No. 2016-138696, filed Jul. 13, 2016, which are hereby incorporated by reference herein in their entirety.

What is claimed is:

1. An image forming apparatus comprising:

an image bearing member configured to bear a toner image;

a transfer member configured to transfer the toner image borne on the image bearing member to a recording material with application of a transfer voltage;

a power supply configured to apply the transfer voltage to the transfer member;

a current detection unit configured to detect a current flowing through the transfer member;

a protection circuit configured to forcibly stop applying the transfer voltage to the transfer member if the current flowing through the transfer member is greater than a predetermined value;

a control unit configured to control the transfer voltage on a basis of a plurality of different test biases applied to the transfer member during a non-image forming period, and a plurality of currents detected by the current detection unit when the plurality of different test biases are applied to the transfer member; and an operation portion configured to be capable of manually inputting a target value for changing the transfer voltage, wherein the control unit is configured to obtain an upper limit voltage on the basis of the plurality of different test biases, the plurality of currents, and a relationship between a voltage and a current being set in advance corresponding to an operation boundary of the protection circuit, and wherein the control unit is configured to control the transfer voltage such that the transfer voltage does not exceed the upper limit voltage if an input voltage corresponding to the target value inputted through the operation portion exceeds the upper limit voltage.

2. The image forming apparatus according to claim 1, wherein the control unit is configured to set a reference voltage to make a predetermined current flow through the transfer member based on the plurality of different test biases and the plurality of currents, and wherein the control unit is configured to set the transfer voltage based on the reference voltage and a predetermined voltage being set corresponding to a type of the recording material to which the toner image is to be transferred.

3. The image forming apparatus according to claim 1, wherein the control unit is configured to set the input voltage as the transfer voltage if the voltage changed through the operation portion does not exceed the upper limit voltage, and wherein the control unit is configured to set the upper limit voltage as the transfer voltage if the voltage changed through the operation portion exceeds the upper limit voltage.

4. An image forming apparatus comprising:

an image bearing member configured to bear a toner image;

a transfer member configured to transfer the toner image borne on the image bearing member to a recording material with application of a transfer voltage;

a power supply configured to apply the transfer voltage to the transfer member;

a current detection unit configured to detect a current flowing through the transfer member;

a protection circuit configured to forcibly stop applying the transfer voltage to the transfer member if the current flowing through the transfer member is greater than a predetermined value;

a control unit configured to control the transfer voltage on a basis of a plurality of different test biases applied to the transfer member during a non-image forming period, and a plurality of currents detected by the current detection unit when the plurality of different test biases are applied to the transfer member;

an operation portion configured to be capable of manually inputting a target value for changing the transfer voltage; and a display portion configured to display a range of settings of the transfer voltage, wherein the control unit is configured to obtain an upper limit voltage on the basis of the plurality of different test biases, the plurality of currents, and a relationship between a voltage and a current being set in advance corresponding to an operation boundary of the protection circuit, and wherein the control unit is configured to change the range of settings of the transfer voltage, which is displayed on the display portion, based on a change of the upper limit voltage.

5. The image forming apparatus according to claim 4, wherein the control unit is configured to set a reference voltage to make a predetermined current flow through the transfer member based on the plurality of different test biases and the plurality of currents, and wherein the control unit is configured to set the transfer voltage based on the reference voltage and a predetermined voltage being set corresponding to a type of the recording material to which the toner image is to be transferred.

6. The image forming apparatus according to claim 4, wherein the control unit is configured to change the range of settings of the transfer voltage, which is displayed on the display portion, such that the range of settings of the transfer voltage does not exceed the upper limit voltage.

7. An image forming apparatus comprising:

an image bearing member configured to bear a toner image;

a transfer member configured to transfer the toner image borne on the image bearing member to a recording material with application of a transfer voltage;

a power supply configured to apply the transfer voltage to the transfer member;

a current detection unit configured to detect a current flowing through the transfer member;

a control unit configured to control the transfer voltage on a basis of a test bias applied to the transfer member during a non-image forming period, and a test current detected by the current detection unit when the test bias is applied to the transfer member; and an operation portion configured to be capable of manually inputting a target value for changing the transfer voltage, wherein the control unit is configured to change an upper limit value of a range of settings of the transfer voltage, being changeable through the operation portion, based on an upper limit voltage obtained on the basis of the test bias and the test current.

8. The image forming apparatus according to claim 7, wherein the upper limit voltage is obtained on the basis of the test bias, the test current, and a predetermined upper limit current.

9. The image forming apparatus according to claim 8, wherein the predetermined upper limit current is determined in advance on the basis of a voltage applied to the transfer member.

10. The image forming apparatus according to claim 8, wherein the control unit is configured to control the power supply such that the test bias is applied to the transfer member in accordance with a start of an image forming job, and wherein the control unit is configured to obtain the upper limit voltage on the basis of a last test bias, a last current, and the predetermined upper limit current.

11. The image forming apparatus according to claim 7, wherein the upper limit voltage is obtained on the basis of the test bias, the test current, and a predetermined relational expression between a current and a voltage.

12. The image forming apparatus according to claim 7, wherein, during the non-image forming period, the control unit is configured to control the power supply such that a plurality of different test biases are applied to the transfer member, and the control unit is configured to obtain the upper limit voltage on the basis of the plurality of different test biases, the plurality of currents detected by the current detection unit when the plurality of different test biases are applied to the transfer member, and a predetermined upper limit current.

13. The image forming apparatus according to claim 7, wherein the control unit is configured to set the transfer voltage as the upper limit voltage if an input voltage corresponding to the target value inputted through the operation portion exceeds the upper limit voltage, and wherein the control unit is configured to set the transfer voltage as the input voltage if the input voltage does not exceed the upper limit voltage.

14. An image forming apparatus comprising:

an image bearing member configured to bear a toner image;

a transfer member configured to transfer the toner image borne on the image bearing member to a recording material with application of a transfer voltage;

a power supply configured to apply the transfer voltage to the transfer member;

a current detection unit configured to detect a current flowing through the transfer a control unit configured to control the transfer voltage on a basis of a test bias applied to the transfer member during a non-image forming period, and a test current detected by the current detection unit when the test bias is applied to the transfer member; and an operation portion configured to be capable of manually inputting a target value for changing the transfer voltage, wherein the operation portion comprises a display portion configured to display a range of settings in which the transfer voltage can be increased, the operation portion being capable of increasing the transfer voltage in the range of settings displayed on the display portion, and wherein the control unit is configured to change the range of settings in which the transfer voltage can be increased, which is displayed on the display portion, based on an upper limit voltage obtained on the basis of the test bias and the test current.

15. The image forming apparatus according to claim 14, wherein the upper limit voltage is obtained on the basis of the test bias, the test current, and a predetermined upper limit current.

16. The image forming apparatus according to claim 15, wherein the predetermined upper limit current is determined in advance on the basis of a voltage applied to the transfer member.

17. The image forming apparatus according to claim 14, wherein, during the non-image forming period, the control unit is configured to control the power supply such that the plurality of different test biases are applied to the transfer member, and the control unit is configured to obtain the upper limit voltage on the basis of the plurality of different test biases, the plurality of currents detected by the current detection unit when the plurality of different test biases are applied to the transfer member, and a predetermined upper limit current.

* * * * *